US007506692B2

(12) United States Patent
Barber et al.

(10) Patent No.: US 7,506,692 B2
(45) Date of Patent: Mar. 24, 2009

(54) TINE RAKING DEVICE

(75) Inventors: John H. Barber, Huntington, CT (US); James P. Barber, Goshen, CT (US)

(73) Assignee: H. Barber and Sons, Inc., Naugatuck, CT (US)

( * ) Notice: Subject to any disclaimer, the term of this patent is extended or adjusted under 35 U.S.C. 154(b) by 0 days.

(21) Appl. No.: 11/290,738

(22) Filed: Nov. 30, 2005

(65) Prior Publication Data

US 2007/0119606 A1 May 31, 2007

(51) Int. Cl.
*A01D 17/00* (2006.01)

(52) U.S. Cl. ..... 171/89; 56/344

(58) Field of Classification Search ..... 56/344–347, 56/350, 351, 361, 400.02, 400.05, 400.07, 56/400.11, 400.13, 400.14, 400.16, 400.21, 56/16.6, 12.9, 327.1, 329; 171/63, 7, 84, 171/86, 93, 95, 98, 107, 130, 85; 15/80–84; 198/693, 308.1, 514, 518; 414/334
See application file for complete search history.

(56) References Cited

U.S. PATENT DOCUMENTS

| | | | | | |
|---|---|---|---|---|---|
| 1,313,053 | A | | 8/1919 | Beard | |
| 1,482,663 | A | | 2/1924 | Shouldice | |
| 1,578,600 | A | | 3/1926 | Greatrix | |
| 2,093,148 | A | | 9/1937 | Hoofnagle et al. | |
| 2,110,997 | A | | 3/1938 | Mayfield | |
| 2,296,851 | A | | 9/1942 | Henry | |
| 2,385,829 | A | * | 10/1945 | Melroe | 198/693 |
| 2,419,154 | A | * | 4/1947 | O'Brien | 171/98 |
| 2,499,615 | A | * | 3/1950 | Tuft | 56/344 |
| 2,593,383 | A | * | 4/1952 | Beaver | 56/350 |
| 2,600,992 | A | | 6/1952 | Kearse | |
| 2,812,029 | A | | 11/1957 | Sund | |
| 2,852,082 | A | | 9/1958 | Petersen | |
| 2,935,834 | A | * | 5/1960 | Vaughn | 56/14.8 |
| 2,976,936 | A | | 3/1961 | Fry | |

(Continued)

FOREIGN PATENT DOCUMENTS

EP 1716743 A1 * 11/2006

OTHER PUBLICATIONS

International Search Report dated Jul. 29, 2007.

*Primary Examiner*—Thomas B Will
*Assistant Examiner*—Jamie L McGowan
(74) *Attorney, Agent, or Firm*—McCormick, Paulding & Huber LLP

(57) ABSTRACT

A tine raking device includes a frame and a conveyor assembly supported on the frame. The conveyor assembly has a conveyor belt defining perforations sized to allow passage therethrough of granules of sand and to prevent passage therethrough of larger sized debris to be removed from a ground surface. Flexible tines extending outwardly from the conveyor belt. The tines are arranged in rows across a width of the conveyor belt. The rows each are longitudinally spaced from adjacent rows along the conveyor belt such that a generally unimpeded path is defined along an outer surface of the conveyor belt for debris to flow between adjacent tines along an associated row. The conveyor assembly includes a lower section for permitting the tines to contact and remove debris from a ground surface being cleaned, and an inclined section for lifting debris on the conveyor belt away from the ground surface being cleaned.

12 Claims, 7 Drawing Sheets

U.S. PATENT DOCUMENTS 3,099,347 A 7/1963 Dahlquist
3,316,977 A * 5/1967 Snook ..... 171/25
3,353,342 A 11/1967 Hill et al.
3,362,480 A 1/1968 Barber
3,554,360 A * 1/1971 Bildsoe ..... 198/833
3,596,717 A 8/1971 Knudsen
3,631,661 A * 1/1972 Volkov et al. ..... 56/364
3,765,159 A * 10/1973 Neff ..... 56/396
4,014,390 A 3/1977 Teixeira
4,050,518 A 9/1977 Gilmour
4,153,555 A 5/1979 Acker et al.
4,157,016 A 6/1979 Wendt et al.
4,167,975 A 9/1979 Fahrenholz
4,282,932 A 8/1981 Anderson
4,482,019 A 11/1984 Murphy
4,542,550 A 9/1985 Bennett et al.
4,603,544 A 8/1986 Hayhurst
4,608,725 A 9/1986 Jackson
4,698,150 A 10/1987 Wigoda
4,993,498 A 2/1991 Fresnel
5,133,413 A 7/1992 Baxter
5,160,034 A 11/1992 Potter
5,184,916 A 2/1993 Thoer
5,197,211 A 3/1993 Haug
5,220,965 A 6/1993 Haug
5,630,476 A 5/1997 Foster et al.
5,816,334 A 10/1998 Haggerty
6,094,847 A 8/2000 Gallenberg
6,540,030 B2 4/2003 Ohzeki et al.
6,568,482 B2 5/2003 Ohzeki et al.
6,612,374 B2 9/2003 Ohzeki et al.
6,634,434 B2 10/2003 Ohzeki et al.
6,640,906 B2 11/2003 Ohzeki et al.
6,675,903 B2 1/2004 Ohzeki et al.
6,763,949 B2 7/2004 Ohzeki et al.
6,857,479 B2 2/2005 Ohzeki et al.
6,899,185 B2 5/2005 Yagisawa et al.
7,086,216 B2 8/2006 Geraghty
7,156,236 B2 * 1/2007 Geraghty ..... 209/421
2005/0188667 A1 * 9/2005 Geraghty ..... 56/344
2005/0188668 A1 * 9/2005 Geraghty ..... 56/344
2005/0189273 A1 9/2005 Geraghty

* cited by examiner

TINE RAKING DEVICE

FIELD OF THE INVENTION

This invention relates generally to the separation of unwanted debris from soil or the like, and more particularly relates to a an improved device for cleaning sand bathing beaches or sand-like tracts of unwanted refuse, litter and other types of debris.

BACKGROUND OF THE INVENTION

The littering propensities of the general public at beaches and other sandy recreation areas appears to be unlimited as to both the quantity and character of the refuse and litter involved and, also, wholly uncontrollable from any practical standpoint. The unavoidable accumulation of such refuse or debris, when coupled with the accumulation of naturally originating debris such as sea grasses, oversized shells, marine residues, and other and varied water deposited material, has created ever increasing problems for those responsible for the maintenance of cleanliness at such locations. The continually increasing magnitude of such problem with the attendant economic aspects of the continually increasing cost of effecting such debris removal has resulted in a demand for mechanized beach deaning apparatus and numerous expedients have been advanced by the art as proposed solutions to the problem. Most of such expedients operate in such manner as to initially skim or otherwise physically separate a predetermined depth of sand from the surface thereof, then screen or otherwise mechanically separate such sand from the debris contained therein and then subsequently return the screened sand to the beach surface and convey the separated debris to a receptacle for ultimate disposition.

The operational capability and efficiency of apparatus incorporating such mode of operation is, however, inherently limited by the rate at which the screening or other mechanical sand-debris separation step can be effected. Such separation rate is determined, at least in part, by the nature and minimum size of debris whose separation is to be effected, the available area for effecting such separation and by the character and moisture content of the sand being cleaned. However, even with dry sand and under the most favorable operating conditions, the rate of sand-debris separation is normally so severely limited for any reasonably sized apparatus as to so circumscribe the permitted rate of unit advance and consequent operational capability to such a point as to render economically feasible use thereof doubtful at best. Moreover, the rate of sand-debris separation markedly decreases in accord with the moisture condition of the sand and most of such conventionally constructed units approach complete inoperability, from any practical standpoint, when high moisture content sand is to be cleaned.

Current technology removes some residual sand along with the debris. Removing this residual sand from the beach is an environmentally unsound practice. Such residual sand removal increases the time required to clean a beach as dump cycles are increased. Increased material removed from the beach results in increased disposal costs.

Current technology is limited in the depth of deaning and quality of cleaning. If tine penetration is increased the amount of sand and smaller debris removed is increased. It is desirable to keep the smaller debris but not the sand—which cannot be done with the current technology.

Current technology requires a change in cleaning depth by the adjusting of the moldboard to maximize cleaning efficiency under different conditions. When tines penetrate more deeply into the sand the distance the material at the surface of the sand needs to be elevated to reach the elevating portion of the conveyor is reduced. This reduced elevating distance will allow for a reduction on conveyor speed required to clean thus extending machine component life.

Accordingly, it is a general object of the present invention to overcome the drawbacks and disadvantages of prior soil cleaning devices.

SUMMARY OF THE INVENTION

In an aspect of the present invention, a tine raking device includes a frame and a conveyor assembly supported on the frame. The conveyor assembly has a conveyor belt defining a plurality of perforations sized to allow passage therethrough of granules of sand and to prevent passage therethrough of larger sized debris to be removed from a ground surface. The tine raking device further includes a plurality of flexible tines extending outwardly from the conveyor belt. The tines are arranged in rows across a width of the conveyor belt. The rows each are longitudinally spaced from adjacent rows along the conveyor belt such that a generally unimpeded path is defined along an outer surface of the conveyor belt for debris to flow between adjacent tines along an associated row. The conveyor assembly further includes a lower section for permitting the tines to contact and remove debris from a ground surface being cleaned, and an inclined section for lifting debris on the conveyor belt in a direction away from the ground surface being cleaned.

In its narrower aspects, the present invention embodies a perforated conveyor mechanism. The perforations allow residual sand removed with the debris to be further separated during the debris transfer up the elevating travel of the conveyor belt so as to allow the sand and small soil-like material to be returned to the ground. The outer surface of the conveyor belt does not include cross bars conventionally used for securing tines to the conveyor belt. Cross bars on the outer surface of the conveyor belt are part of the current technology and are eliminated herein to allow the free flow of debris between tines and down the conveyor. Moreover, the base of the tines including a coil or other flexible section is recessed relative to the outer surface of the conveyor belt to further facilitate the flow of debris down the elevating portion of the conveyor.

The separation process is further enhanced as debris being elevated passes between sets of tines—unimpeded by the absence of cross members otherwise conventionally disposed on the outer surface of the conveyor belt—and impacts on the following offset tine. Lumps are comminuted during the impact which renders a subsequent separation of debris and sand easier. The impact with the following tine further dislodges sand from the debris being elevated allowing it to pass through perforations and be returned to the ground. This pinball action repeatedly impacts the debris being removed quantitatively reducing the amount of sand adhering to the debris and reducing substantially the amount of sand transferred to the debris receptacle or hopper.

Performance is further enhanced in that the tine penetration into the sand or soil-like material may be increased. When this is done with the current technology the amount of sand and small debris picked-up is increased resulting in the unnecessary removal of sand. The perforations in the conveyor belt and the pinball action of the material as it is displaced to the material hopper now allow for some sand and small material to be removed because further separation will occur and the sand will be returned to the ground. The small debris which would not normally be removed with the existing technology can now be separated and elevated to the hopper. The result of the increased depth of deaning is a cleaner beach. The beach has been cleaned to a greater depth and more small debris has been removed leaving more pure sand.

The increased distance the tines extend below the moldboard allows for less operator involvement in adjusting the machine to the conditions of the beach. A less qualified operator will now be able to operate the machine. The operator will be subject to less fatigue and potential injury due to a reduction in repetitive motion.

This cleaning of the beach by raking and sifting techniques is accomplished with one conveyor mechanism and a single power source. This simple design allows for economies of manufacture and minimized repair costs.

Increasing the height of the moldboard relative to the tines removes the board from an area of potential trauma. Large rocks, logs, jetties, etc. can damage the moldboard and connected frame when impacted. The farther the moldboard is elevated from the working surface the less likely it is to be damaged.

Increasing the height of the moldboard relative to the tines reduces the volume of material which must be carried in front of the board to level the beach. This in turn reduces the force required to level the beach. A smaller towing unit with less horse power is required resulting in increased fuel economy and a reduction in the cost of the towing unit.

DETAILED DESCRIPTION OF THE PREFERRED EMBODIMENT

Figure 1:
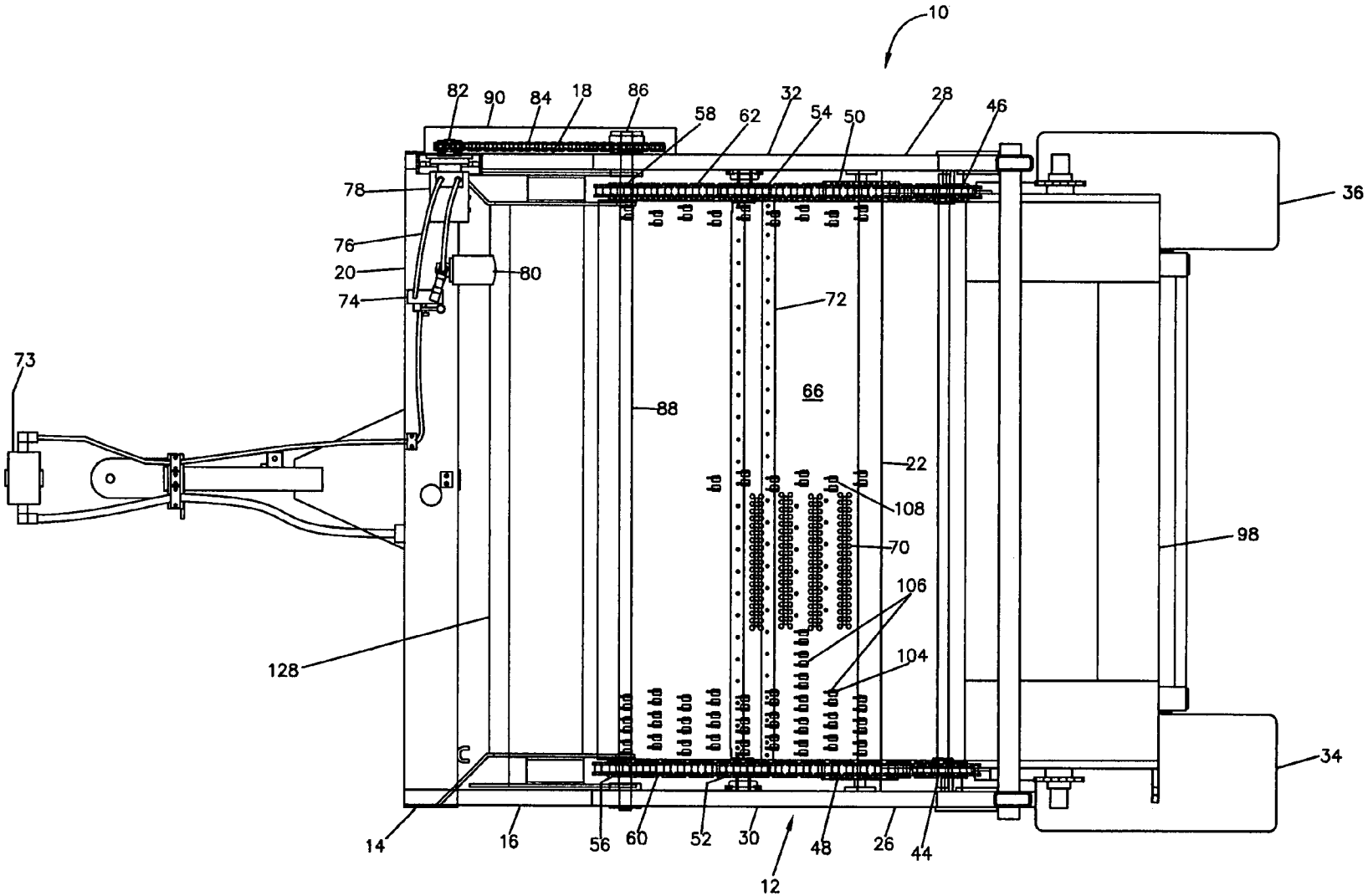
FIG. 1 is a top plan view of a tine raking device embodying the present invention.
Figure 2:
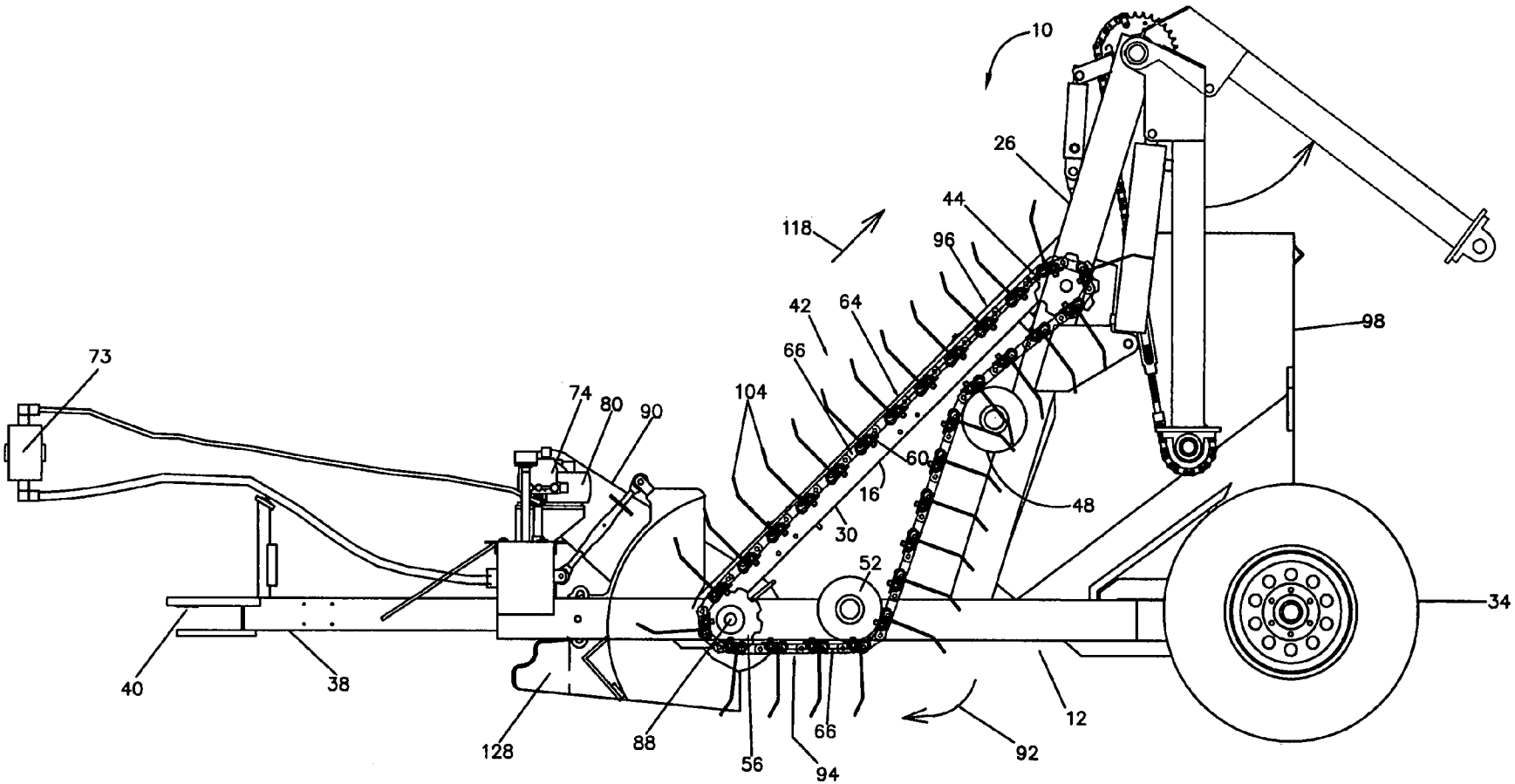
FIG. 2 is a side elevational view of the tine raking device of FIG. 1.

With reference to FIG. 1 and 2, a tine raking device embodying the present invention is generally indicated by the reference number 10. The device 10 includes a generally rectangularly shaped, perimetric base frame 12 suitably formed of beam members generally designated 14 such as angle, channel iron or tubing. The frame 12 has a pair of spaced side frame members 16 and 18 that are terminally bridged by front and rear frame members 20 and 22 respectively. A pair of generally triangularly shaped conveyor frame assemblies formed of rectangular tubing are mounted upon a rear half of the side frame members 16 and 18 and extend upwardly therefrom. The conveyor frame assemblies include an upwardly or generally vertically disposed conveyor frame members 26 and 28 mounted at a rear of each of the side frame members 16, 18. The conveyor frame assemblies also include generally angularly disposed brace members 30 and 32 respectively coupled at one end to the conveyor frame members 26 and 28, and respectively coupled at another end to the side frame members 16, 18 in the vicinity of the midpoint thereof.

The frame 12 is terminally supported at a rear or trailing end by a pair of pneumatic tired wheels 34, 36 of suitable size to support the frame 12 in predetermined spaced relation to a sand beach or other surface to be cleaned.

A beam or draw bar serving as a towing unit 38 is secured to and extends forwardly of the front frame member 20. The towing unit 38 has a connector 40 such as an eye or hole at a terminal end thereof for coupling the device 10 to a vehicle such as a tractor to effect the advance of the device 10 relative to a sand beach or other surface to be cleaned.

The frame 12 supports an independently displaceable tine supporting conveyor belt assembly 42 having a path of travel in the general configuration of a scalene triangle. Included in the conveyor belt assembly 42 and defining the terminal points of a specified path of travel are a pair of first idler sprockets 44, 46 mounted at an apex of the conveyor frame assemblies, a pair of first idler rollers 48, 50 mounted on the conveyor frame members 26, 28 of the conveyor frame assemblies, a pair of second idler rollers 52, 54 positioned on the side frame members 16, 18, and a pair of drive sprockets 56, 58 mounted on the side frame members 16, 18. The respective pairs of the first idler sprockets 44, 46, the first idler rollers 48, 50, the second idler rollers 52, 54, and the drive sprockets 56, 58 are operatively interconnected by multi4ink chain members 60, 62 which form a supporting component for a bar flight conveyor 64 covered with a conveyor belt 66 including a laminated rubber belting or mesh screen material. The conveyor belt 66 defines a plurality of perforations 70 sized to pass granules of sand therethrough and to prohibit the passage of debris to be removed from the surface being cleaned as explained more fully below. By way of example only, the perforations can range from about ⅜ inch to about 1 inch in length or diameter depending on the average size of the grains of sand on a particular beach. However, it should be understood that the size of the perforations can be smaller or larger than the above-identified range without departing from the scope of the present invention. An inner surface of the conveyor belt 66 includes a plurality of uniformly spaced channel shaped cross bars or beams 72 each terminally secured to outside links of the chain members 60, 62 which serve to support and provide a base connection for the rubber surfaced, laminated and perforated conveyor belt 66. There are no cross bars on an outer surface of the conveyor belt 66 as is typically found in prior conveyors for reasons to be explained more fully below.

The displacement of the conveyor belt 66 of the conveyor 64 over the path of travel defined by the pair of first idler sprockets 44, 46, the pair of first idler rollers 48, 50, the pair of second idler rollers 52, 54, and the pair of drive sprockets 56, 58 relative to the frame 12 is conveniently effected by transferring power hydraulically from a towing unit or vehicle to the drive sprockets. A hydraulic pump 73 is mounted to a spline shaft at the back of the towing unit 38. Hydraulic power is delivered to a flow control valve 74, with overflow protection, which is mounted on the frame 12. Power is then transferred by a hose 76 to a hydraulic drive motor 78 mounted on the front frame member 20. Oil then passes through a hydraulic filter 80 to the front frame member 20 which also serves as a hydraulic reservoir. The hydraulic drive motor 78 has a sprocket 82 mounted on an end thereof which is in turn connected through an auxiliary drive chain 84 to a sprocket 86. The sprocket 86 is drivingly mounted on a common shaft 88 with the drive sprockets 56, 58 for the chain members 60, 62. Because of their disposition exteriorly of the perimetric frame 12, the sprockets 82, 86 and the auxiliary drive chain 84 are preferably covered by a suitable guard member 90.

As will be apparent to those skilled in the pertinent art, operation of the above-described components forming a drive system effects displacement of the conveyor 64 in the clockwise direction as indicated by the directional arrow 92 along a path in the general configuration of a scalene triangle. Such path includes a base leg portion 94, disposed intermediate of the pair of second idler rollers 52, 54 and the drive sprockets 56, 58, that is substantially parallel to the base frame 12 and of limited length and, after an abrupt change of direction during passage over the drive sprockets 56, 58, an inclined conveyor leg portion 96 that terminates at an elevated location above the mouth of a debris receiving hopper 98.

Figure 3:
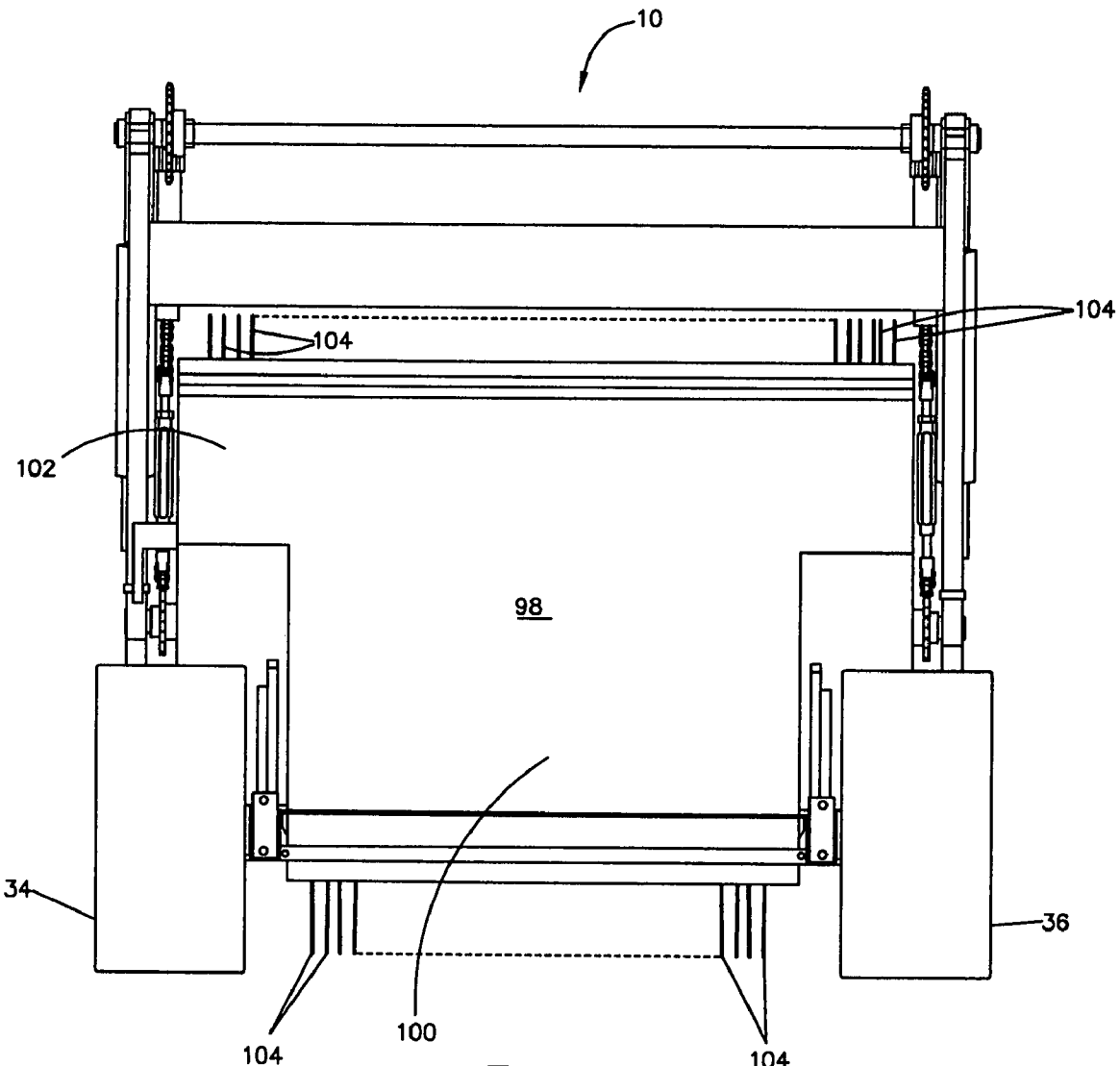
FIG. 3 is a rear elevational view of the tine raking device of FIG. 1.

As shown in FIGS. 1-3, the hopper 98 is mounted on a rear of the base frame 12 and is preferably shaped so as to have a lower portion 100 sized to be disposed between the wheels 34, 36 and with an upper portion 102 of increased transverse extent so as to overhang the wheels to provide for maximum debris containing capacity thereof.

Figure 4:
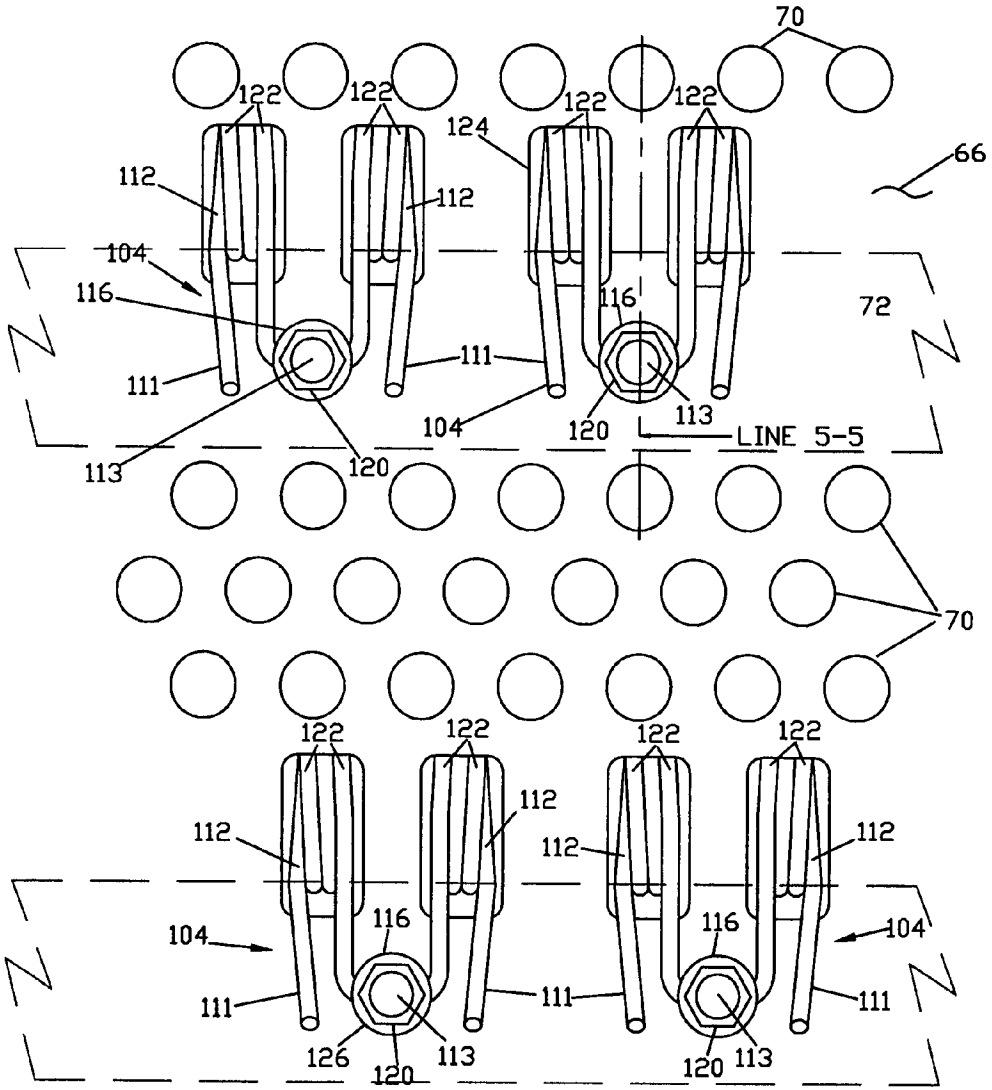
FIG. 4 is an enlarged plan view of a tine and its mounting in accordance with the present invention.
Figure 5:
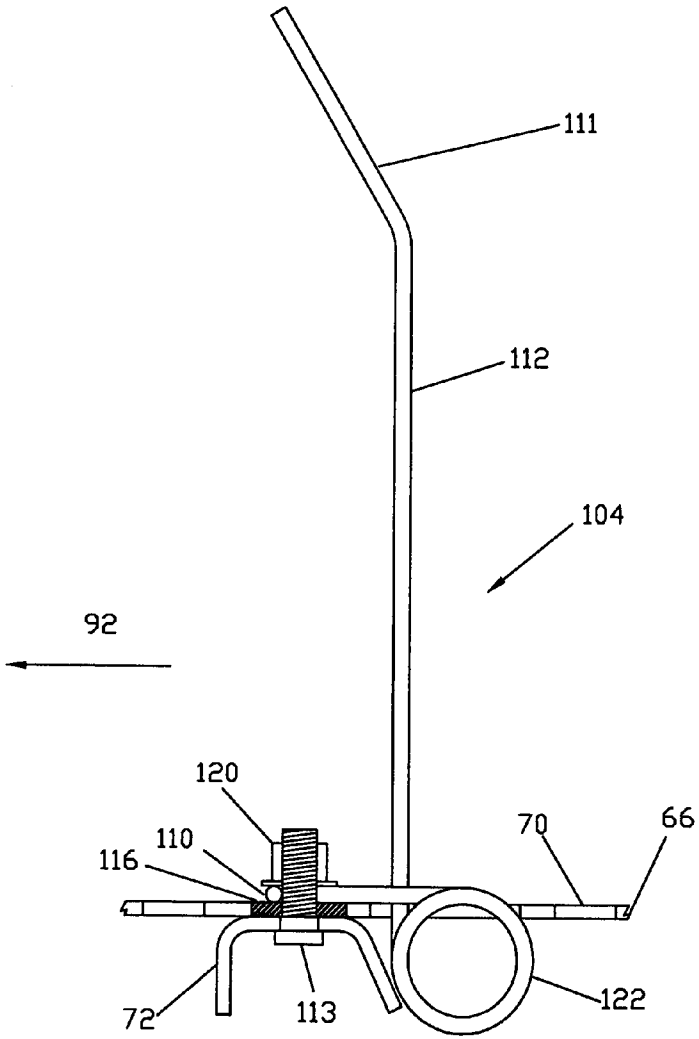
FIG. 5 is a cross-sectional, side elevational view of a tine and its mounting taken along the line 5-5 of FIG. 4.

A plurality of spring-like or flexible tines 104 are mounted within the conveyor belt 66. The tines 104 are preferably arranged in spaced rows 106 transverse to the direction of conveyor advance and with the individual tines 104 in each row being disposed in staggered or offset relationship from the tines in the rows immediately preceding and following the same as illustrated at 108. As best shown in FIGS. 4 and 5, each of the spring-like tines 104 is preferably made of spring steel or like material with a flexible section such as a coil section 122 including a base portion 110 with two parallel legs 112 extending vertically from the base. The parallel legs 112 each have a body portion and an end portion 111 angularly disposed or offset relative to the body portion in a direction of travel of the tines.

As best shown in FIG. 5, the base portion 110 of each of the tines 104 is formed to accept a stud 113 or other securing mechanism to mount the base portion 110 of an associated tine 104 to a cross bar 72 of the conveyor belt 66 with a washer 116 and the conveyor belt 66 disposed therebetween. The mounting of each spring-like tine 104 on the conveyor belt 66 is readily effected by disposition of the base portion 110 of an associated tine in overlying relationship with a washer 116 and the cross bars 72 of the conveyor 64. More specifically, the base portion 110 of each of the tines 104 is positioned so as to dispose the end portions 111 in the direction of conveyor belt advance as indicated by the directional arrow 118. When each of the tines 104 is so located in a given row 106, each of the tines is secured in position by means of a locking nut 120 over the base portion 110 thereof and secured to underlying cross bars 72 of the conveyor 64. A stud 113 located internally in the cross bar 72 passes through the conveyor belt 66 and an associated washer 116, and then through the associated tine 104 and secured above by a locking nut 120 with a flanged base. The conveyor belt 66 and a washer 116 are thus secured in place between the associated tine 104 and the cross bar 72. Each of the tines 104 is held in correct orientation relative to the cross bar 72 by positioning of coil section 122 or other flexible section of an associated tine 104 immediately adjacent to the cross bar.

As best shown in FIG. 4, the conveyor belt 66 is made of laminated rubber covered perforated belting material or screen mesh defining perforations 70 of a size and shape to effectively allow the passage of sand and other small particulate material. The perforations 70 are in staggered rows 106 so that perforations in one row are lineally offset from the perforations in the immediately preceding row. No perforations 70 are positioned over the cross bars 72. Additional perforations 124 each of a size to accommodate a coil section 122 or other flexible section of a tine 104 in a recessed position relative to the outer surface of the conveyor belt 66 are defined by the conveyor belt 66 in rows parallel with the cross bars 72 to match the staggered tine configuration. Additional perforations 126 are defined by the conveyor belt 66 to accommodate the studs 113.

Figure 6:
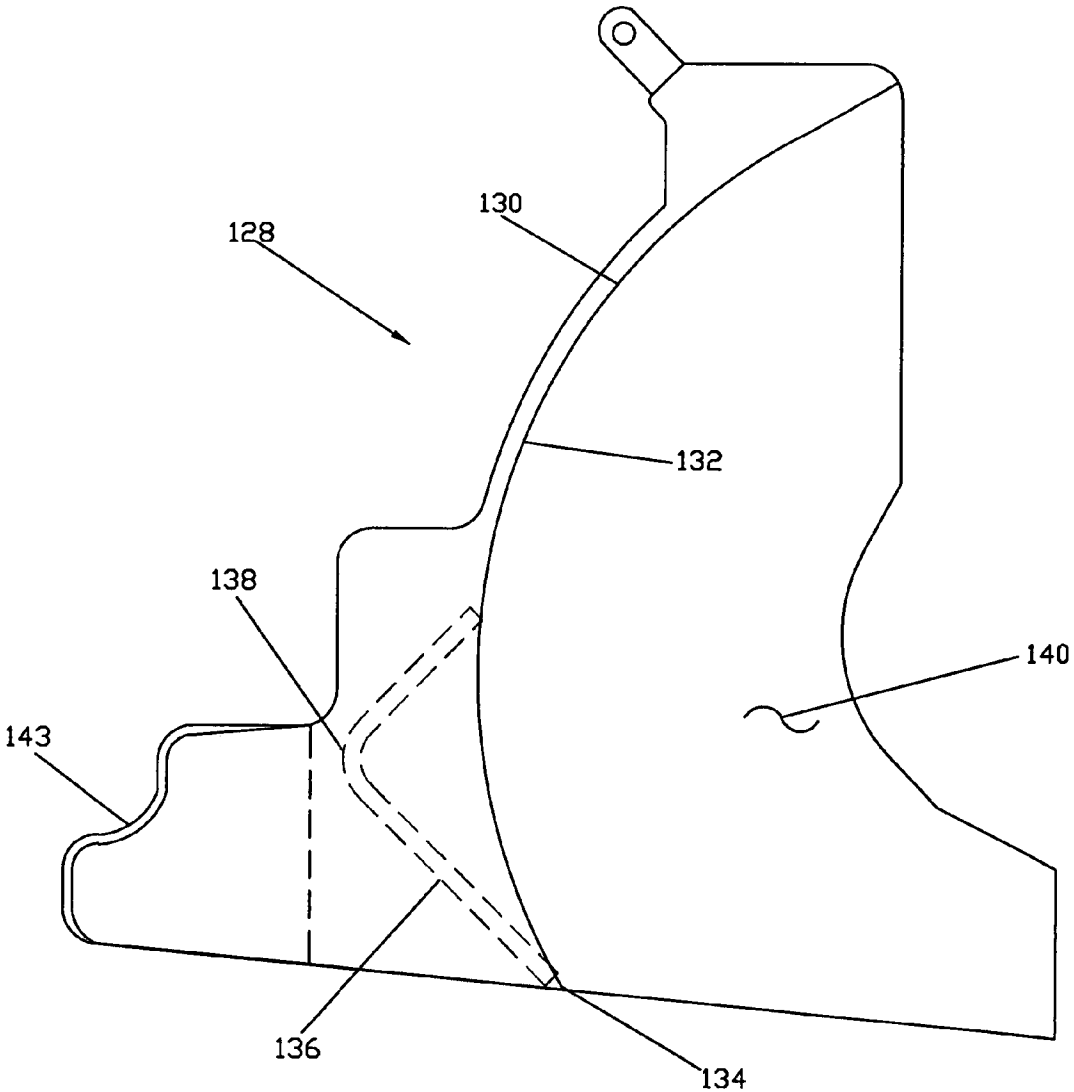
FIG. 6 is a side elevational view of a debris deflection shield in accordance with the present invention.
Figure 7:
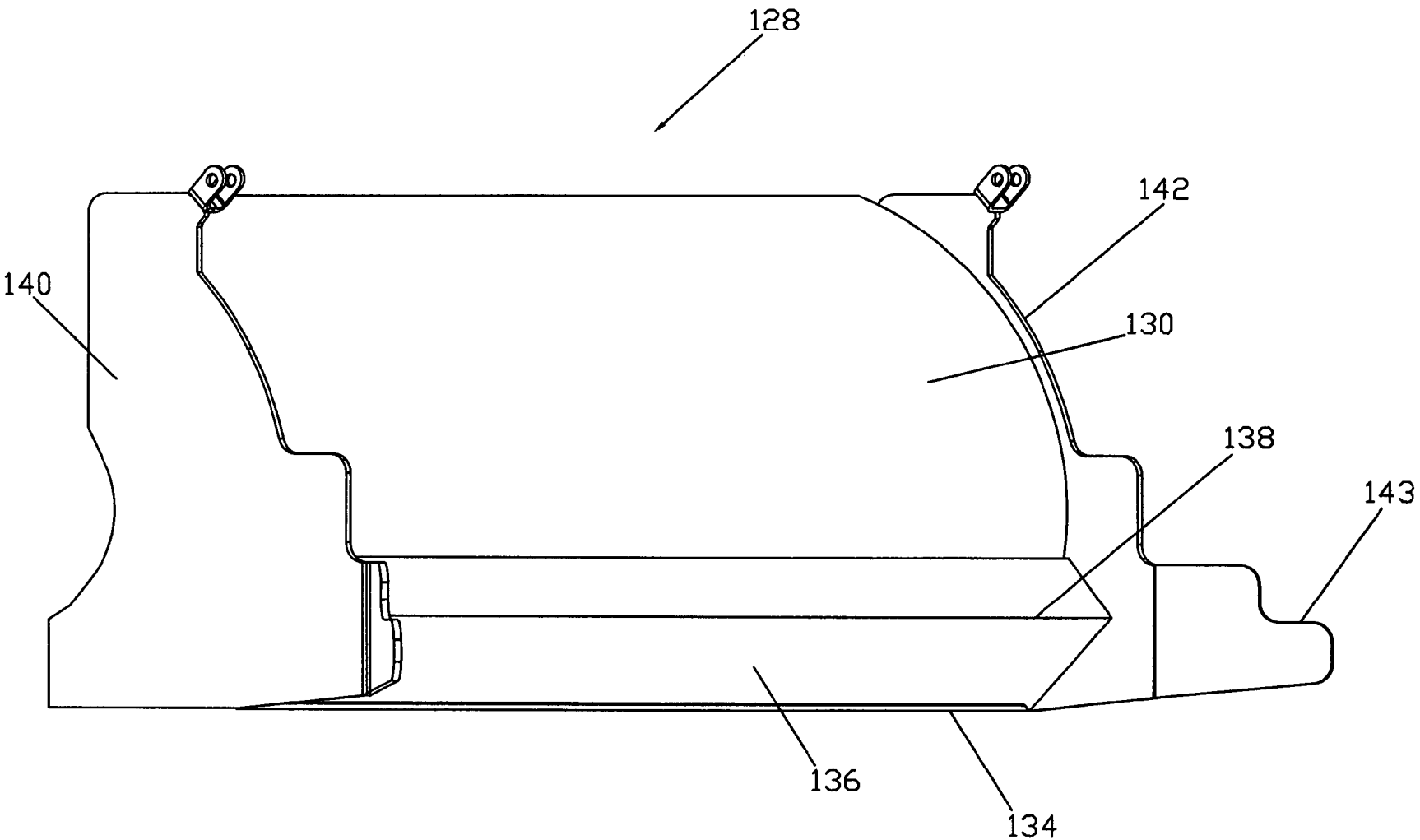
FIG. 7 is a perspective view of the debris shield of FIG. 6.

The device 10 further includes a debris deflection shield-moldboard assembly 128. The moldboard assembly 128 is disposed between the side frame members 16, 18 in front of the drive sprockets 56, 58 and extending across the transverse extent of the conveyor belt assembly 42. The moldboard assembly 128 includes an elongate debris deflection panel 130 extending across a full width of the conveyor belt 66. The debris deflection panel 130 is of a generally rectangular perimetric configuration and is selectively shaped in cross-section, as shown in FIG. 6, to provide a generally concentric radius shaped portion 132. Extending forwardly from a lower transverse marginal edge 134 of the deflection panel 130 is a planar skid member 136 extending across a full width of the deflection panel 130 and being disposed at an angle to the horizontal so as to elevate a forward or leading marginal edge 138 thereof. Disposed at either end of the deflection panel 130 are steel plate members or side plates 140, 142 that extend over the full height of the deflection panel 130 and rearwardly thereof to contain debris displaced by the tines 104 within the transverse extent of the conveyor belt 66. A leading section 143 of the side plates 140, 142 are canted outwardly to deflect surface debris disposed outside of the path of tine travel to within the path of the tines 104.

The skid member 136 cooperatively functions to increase cleaning efficiency in that the skid member 136 both levels the sand surface to be cleaned before cleaning occurs by knocking down high areas and filling in low areas and operates to funnel debris into position and therefore render the same more susceptible to deflection through elastic reformation of the tines 104 as the tines start their displacement around the drive sprockets 56, 58. The leveling action prior to the extraction of debris ensures a consistent cleaning depth.

The elevated leading marginal edge 138 of the planar skid member 136 is sufficiently raised above the plane of the working area to place the skid member above particularly large objects which could, if struck directly, cause structural damage. The angled planar surface of the skid member 136 effectively rides over large objects if encountered so as to render them harmless to the structural integrity of the device 10.

Operation of the device 10 in a cleaning operation on a sand beach, for example, is effected by connecting the draw bar or towing unit 38 to a tractor or the like. During forward movement of the device 10, the skid member 136 levels the sand and also funnels material into the cleaning path of the tines 104.

In operation, the device 10 is moved in a forward direction by a vehicle such as a tractor. The depth of tine penetration is pre-set by the relative positions of the moldboard assembly 128 to the tines 104. The conveyor belt 66 with the tines 104 mounted thereon is independently advanced relative to the frame 12 and in the direction indicated by the arrows 92. The direction of such independent advance of the tines 104 through the sand to be cleaned is in the same direction as that of the frame 12 of the device 10. The effect of the above-mentioned movements of the frame 12 and the tines 104 is the sequential passage of the rows 106 of the spring-like tines 104 through the sand to be cleaned and an accumulation of litter, refuse or other debris disposed in the path of tine advance at a forward end of the conveyor belt assembly 42.

As the conveyor belt 66 passes over the drive sprockets 56, 58, the direction of movement of the tines 104 is abruptly changed and the speed of the end portions 111 thereof is increased. Such change in direction and rate of displacement results in a bending deformation of the tines 104 against the inherent resistance of the associated coil section 122 or other flexible section and the base portion 110 thereof. Such deformation progressively increases during change of direction and is abruptly released as the tines 104 lift away from the sand surface. Such release of the stored kinetic energy effects a reformation of the tines 104 and in a consequent displacement of any debris in their path upwardly and out of the sand. The debris displaced from the sand is either lifted directly by the tines 104 or is deflected off of the deflection panel 130 onto an inclined portion of the conveyor belt 66 disposed between the drive sprockets 56, 58 and the first idler sprockets 44, 46. Most, if not all, of the sand deflected by the snap action of the tines 104 and by the displaced debris will return to the beach surface through a passage between the deflection panel 130 and the forward end of the conveyor belt 66. The debris along with some sand will then start to travel up on the conveyor belt 66 in the direction shown by the arrow 92.

The elimination of cross bars on the outer surface of the conveyor belt 66 permits the outer surface of the conveyor belt 66 and the tines 104 to define a generally unimpeded path along the outer surface of the conveyor belt for debris to flow between adjacent tines along an associated row. Moreover, the coil section 122 or other flexible section of each of the tines 104 is recessed relative to the outer surface of the conveyor belt 66 to further define the generally unimpeded path for reasons which will now be explained.

Some particularly large material will travel directly up on the conveyor belt 66. Most of the moderate and smaller sized material will progress up on the conveyor belt 66 at a reduced rate relative to the rate of conveyor belt travel. The reduced rate of travel up on the conveyor belt 66 of the debris is due to the force exerted on the debris by gravity, the relatively smaller size of the debris as compared to the spacing between the tines 104 along a row 106, and the relatively steep upward angle of travel of the conveyor belt 66. This debris will be bypassed by a row 106 of tines 104 as the debris passes along a generally unimpeded path between the individual tine 104 (more specifically, between the tine legs 112) along a row and over the perforations 70 of the conveyor belt 66 until the debris is struck by one of the tines 104 in the following offset row. This impact serves two purposes. It will continue to project the debris in a path generally conforming to the path of travel of the conveyor belt 66 while frequently being displaced laterally relative to the direction of travel of the conveyor belt. The impact will also tend to dislodge any residual sand adhering to the debris.

This "pinball" action of the debris as it progresses up on the conveyor belt 66 is a repeated striking of the debris while the debris is in a variety of orientations to effectively dislodge from the debris any residual sand adhering thereto. The dislodged sand then passes through the perforations 70 of the conveyor belt 66 and back onto the beach. In other words, loose sand and small debris picked up by the tines 104 is selectively returned to the beach area. The size of the material returned is directly related to the size of the perforations 70 on the conveyor belt 66. The deflected debris moves with the continued upward displacement of the conveyor belt 66 and drops into the hopper 98 as the conveyor belt 66 is advanced past the first idler sprockets 44, 46. Such pinball action is not possible with conventional tine raking devices which employ cross members on the outer surface of the conveyor belt to secure the tines thereto. Such cross members on the outer surface of the conveyor belt impede or prevent the debris to pass between a row of tines and impact the adjacent staggered row of tines to thereby dislodge sand from the debris.

As will be recognized by those of ordinary skill in the pertinent art, numerous modifications and substitutions can be made to the above-described embodiment of the present invention without departing from the scope of the invention. Accordingly, the preceding portion of this specification is to be taken in an illustrative, as opposed to a limiting sense.

What is claimed is:

1. A tine raking device comprising:

a frame;

a conveyor assembly supported on the frame, the conveyor assembly having a conveyor belt including a laminated rubber-type belting material defining a plurality of perforations sized to allow passage therethrough of granules of sand and to prevent passage therethrough of larger sized debris to be removed from a ground surface; and a plurality of flexible tines extending outwardly from the conveyor belt, the tines being arranged in rows across a width of the conveyor belt, the rows each being longitudinally spaced from adjacent rows along the conveyor belt and an outer surface of the conveyor belt being uncovered between adjacent tines along an associated row such that a generally smooth surface and unimpeded path is defined along the outer surface of the conveyor belt including between adjacent tines along an associated row for debris to flow between the adjacent tines, the tines in each row being disposed in staggered relationship along a width of the conveyor belt relative to the tines in the adjacent rows, the tines each including two generally parallel legs spaced from one another and connected together by a coil section, and wherein the conveyor belt defines a plurality of additional perforations each to accommodate a coil section of a tine in a recessed position relative to the outer surface of the conveyor belt;

the conveyor assembly further including:

a lower section for permitting the tines to contact and remove debris from a ground surface being cleaned; and an inclined section for lifting debris on the conveyor belt in a direction away from the ground surface being cleaned.

2. A tine raking device as defined in claim 1, further comprising a hopper disposed adjacent to an upwardmost portion of the inclined section of the conveyor belt for collecting the debris.

3. A tine raking device as defined in claim 1, further comprising a moldboard assembly coupled to a forward portion of the frame for leveling the ground to be cleaned prior to removal of debris therefrom.

4. A tine raking device as defined in claim 1, further comprising a deflection panel coupled to the frame forwardly of the lower section of the conveyor assembly for deflecting debris from the lower section onto the inclined section of the conveyor assembly.

5. A tine raking device as defined in claim 1, further comprising a draw bar attached to a forward portion of the frame for coupling the frame to a towing vehicle.

6. A tine raking device as defined in claim 1, wherein the coil section includes a base portion for being coupled to the conveyor belt.

7. A tine raking device as defined in claim 1, wherein the tines are made from spring steel.

8. A tine raking device as defined in claim 1, wherein the legs of the tines each include a body portion and an end portion, the end portion being angularly offset relative to the body portion in a direction of travel of the tines.

9. A tine raking device as defined in claim 1, further comprising:

a pump to be powered by a vehicle; and a motor operatively coupled to the pump for driving the conveyor assembly.

10. A tine raking device as defined in claim 9, wherein the pump is a hydraulic pump.

11. A tine raking device as defined in claim 9, wherein the motor is a hydraulic motor.

12. A tine raking device as defined in claim 1, further comprising a plurality of cross bars coupled to an inner surface of the conveyor belt to support the conveyor belt.

* * * * *